US005632849A

United States Patent [19]

Ogren et al.

[11] Patent Number: 5,632,849

[45] Date of Patent: May 27, 1997

[54] TAB APPLICATOR FOR LOG ROLL WINDERS

[75] Inventors: Harvey D. Ogren, Dellwood, Minn.; James L. Albrecht, Wahpeton, N. Dak.; Leonard M. Volin, Grant Township, Washington County, Minn.

[73] Assignee: Minnesota Mining and Manufacturing and Company, St. Paul, Minn.

[21] Appl. No.: 823,379

[22] Filed: Jan. 21, 1992

[51] Int. Cl.[6] ..... B65C 3/12

[52] U.S. Cl. ..... 156/446; 156/504; 156/518; 156/519; 156/520; 242/555.6

[58] Field of Search ..... 156/446, 518, 156/520, 516, 517, 519, 522, 502, 504; 242/56 R, 56 A, 56.3

[56] References Cited

U.S. PATENT DOCUMENTS

| | | | |
|---|---|---|---|
| 2,668,023 | 2/1954 | Whitson et al. | 156/519 X |
| 2,872,126 | 2/1959 | Rockstrom et al. | 242/65 |
| 4,157,794 | 6/1979 | Brandauer et al. | 242/66 |
| 4,422,588 | 12/1983 | Nowisch | 242/56 |
| 4,485,979 | 12/1984 | Dropczynski | 242/56 |
| 4,487,377 | 12/1984 | Perini | 242/56 |
| 4,601,441 | 7/1986 | Oinonen et al. | 242/56 |
| 4,635,867 | 1/1987 | Kytönen | 242/56 |
| 4,659,029 | 4/1987 | Rodriguez | 242/56 |
| 4,678,133 | 7/1987 | Suzuki | 242/56 |
| 4,700,905 | 10/1987 | Oppelt et al. | 242/67 |
| 4,712,459 | 12/1987 | Walkiewicz, Jr. et al. | 83/171 |
| 4,715,926 | 12/1987 | Murasaki | 156/520 X |
| 4,723,724 | 2/1988 | Bradley | 242/56 |
| 4,749,139 | 6/1988 | Snygg | 242/56 |
| 4,775,110 | 10/1988 | Welp et al. | 242/56 |
| 4,842,209 | 6/1989 | Saukkonen | 242/56 |
| 4,852,820 | 8/1989 | Looser | 242/65 |
| 4,856,725 | 8/1989 | Bradley | 242/66 |
| 4,858,843 | 8/1989 | Gierse et al. | 242/65 |
| 4,867,387 | 9/1989 | Schönmeier | 242/65 |
| 4,919,351 | 4/1990 | McNeil | 242/56 |

FOREIGN PATENT DOCUMENTS

| | | | |
|---|---|---|---|
| 480675 | 1/1952 | Canada | 156/520 |
| 0335028 | 10/1989 | European Pat. Off. | B65H 18/22 |
| 2336334 | 7/1977 | France | B65H 19/20 |
| 1137221 | 12/1968 | United Kingdom | B65H 19/22 |
| 1164885 | 9/1969 | United Kingdom | B65H 19/26 |
| 1167767 | 10/1969 | United Kingdom | B65H 19/22 |
| 1207080 | 9/1970 | United Kingdom | B65H 17/30 |
| WO87/06218 | 10/1987 | WIPO | B65H 19/22 |

*Primary Examiner*—David A. Simmons
*Assistant Examiner*—Paul M. Rivard
*Attorney, Agent, or Firm*—Gary L. Griswold; Walter N. Kirn; James J. Trussell

[57] ABSTRACT

The winding system includes several rollers and a rotating drum, around which the web winds before being wound on a core. A cutting and tabbing assembly cuts the web against the rotating drum and cuts and applies the tab on the web in registration with the cut end of the web. The cutting and tabbing assembly includes a wheel, a knife mounted on the wheel, and a tab bar mounted on the wheel adjacent the knife. During the winding of the web on the core the proper amount of tab paper is unwound and moved toward the knife to cut and grab the tab. Then, the knife and tab bar rotate to cut the web while the tab bar applies the tab onto the cut end of the web.

29 Claims, 4 Drawing Sheets

TAB APPLICATOR FOR LOG ROLL WINDERS

TECHNICAL FIELD

The present invention relates to log roll winders. More particularly, the present invention relates to log roll winders having tab applicators that automatically apply tabs to the web.

BACKGROUND OF THE INVENTION

Most known log roll winders cut the web while the web is in the air, rather than against a drum. As the knife cuts, it forces the web against a new core. However, as the tail of the web is not supported, the web, particularly thin webs, will not lay down smoothly against the core and wrinkles are produced on the outer wraps. Winders of this type are made by Fuji Tekko.

U.S. Pat. No. 4,775,110 to Welp et al. describes a log roll winding system in which a complex cutting system is used to sever the web. A cutter perforates the web along a line and the web is braked to sever the web. Cutting is not performed on the fly.

Some high speed log roll winders wind a web of material around large rollers and onto cores by cutting, tabbing, and transferring the web in a nonstop process. The completed log rolls have the same web length as the finished product rolls but have a full web width. The log rolls are lathe slit to the desired product width without rewinding. If the finished rolls require tabs, such as to mark the end of the rolls, the tabs are applied to the ends of the log roll before slitting. The tabs are narrow strips of material such as paper. The tabs are preslit to the desired length of 0.63 cm to 1.27 cm (0.25 in to 0.5 in) and have a width equal to the width of the log roll. The tabs are applied individually to each log roll.

These systems typically apply the tabs to a log roll either manually or from a magazine. Tab application is sometimes performed with the web stopped and sometimes with the web moving. Regardless, the tab is applied as a separate operation before the web is cut to terminate the log roll. It is very difficult to properly align the tab next to the cut edge of the web.

SUMMARY OF THE INVENTION

The tabbing system of the present invention can be used in conjunction with known tape handling and winding systems. The web is wound on cores, preferably with a winding system which permits transferring the web between cores on the fly. The winding system includes several rollers around which the web winds. The web then travels to and around a rotating drum disposed after the rollers. The web travels in intimate contact with a portion of the surface of the rotating drum. The web has an adhesive side which faces outwardly when the web is wrapped around the rotating drum. Two wind-up spindles are located adjacent the rotating drum and alternately receive the cores on which the web is wound.

A cutting and tabbing assembly cuts the web against the rotating drum as the web rotates and cuts and applies the tab on the web precisely in registration with the cut end of the web. The cutting and tabbing assembly includes a wheel, a knife mounted on the wheel, and a tab bar mounted on the wheel adjacent the knife. The tab bar includes a vacuum source which holds the tab paper. The tab paper is in the form of a roll which is mounted on an unwinder adjacent the wheel.

During the winding of the web on its core, the wheel is located in the tab-receiving position and the unwinder is spaced from the wheel. After the unwinder unwinds the proper amount of tab paper, the tab paper is threaded between the knife and the unwinder. The unwinder is then moved to contact the knife and tab bar. As the tab paper contacts the knife, the knife cuts a tab from the tab paper and the tab is held on the tab bar. When the desired length of web has been wound on its core, the wheel rotates toward the web-cutting position in which the knife can cut the web. As the wheel rotates, the tab bar transports the tab to the web. As the wheel reaches the web, the tab is applied and the knife contacts and cuts the web. The tab bar accurately applies the tab onto the web in registration with the cut end of the web. The knife and tab bar continue to rotate until reaching its beginning position, and the sequence can begin again.

DETAILED DESCRIPTION OF PREFERRED EMBODIMENTS

Figure 1A:
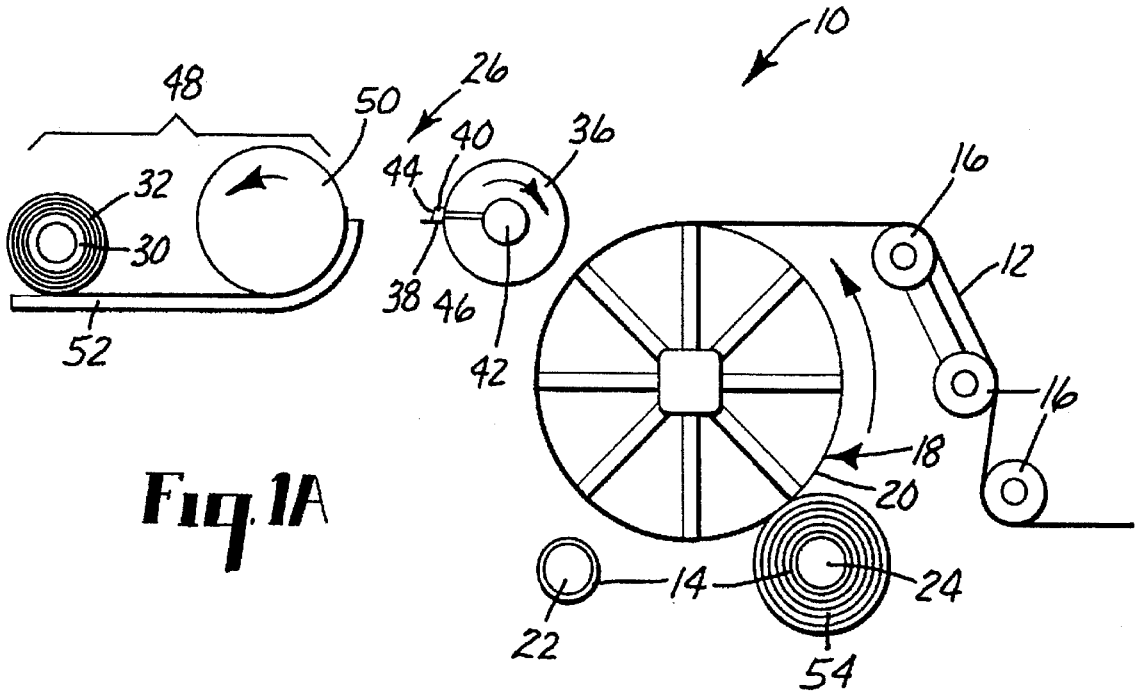
FIGS. 1A–1E are schematic views of the tabbing system of the present invention used with a winding system during the web cutting and tab applying step.

The tabbing system of the present invention can be used in conjunction with most known tape handling and winding systems 10. After the web 12 is processed it is wound on cores 14, preferably with a winding system 10 which permits transferring the web 12 between cores 14 on the fly. As shown in FIG. 1, the winding system 10 includes at least one and preferably several rollers 16 around which the web 12 first winds. The web 12 then travels to and around a rotating drum 18 disposed after the rollers 16. The web 12 travels in intimate contact with a portion of the surface 20 of the rotating drum 18.

The rotating drum outer surface 20 is covered with urethane rubber or other elastomeric material which firmly supports the web 12 such that a cutting knife will penetrate the web 12 when the knife is pressed against the web 12. The drum surface 20 can be steel as long as the knife travel is precisely controlled to avoid knife damage. Also, the surface 20 can have a narrow groove which would engage the knife such that the edges of the groove would support the web 12 close to the cut while the cut is actually made in the open air space between the edges of the groove. Preferably, the web 12 has an adhesive side which faces outwardly when the web 12 is wrapped around the rotating drum 18. This prevents the web 12 from adhering to the drum surface 20 and permit the web 12 to transfer to the cores 14 by adhesion. Adhesion transfer to the cores 14 with nonadhesive webs can be accomplished by placing adhesive directly on the cores. Adhesive webs 12 permit the tab to be adhered to the web without adhesive on the tab.

Two wind-up spindles 22, 24 are located adjacent the rotating drum 18 and receive the cores 14 on which the web 12 is wound. A first wind-up spindle 22 is located relatively upline of a second wind-up spindle 24. Both wind-up spindles 22, 24 are movable between a first position in contact with the rotating drum 18 and a second position spaced away from the rotating drum 18. In alternative embodiments, a turret can be used to hold several wind-up stations and to load and unload the wind-up spindles continuously.

A cutting and tabbing assembly 26 is located upline of both wind-up spindles 22, 24. The assembly 26 cuts the web 12 against the rotating drum 18 as the web 12 rotates and cuts and applies a tab 28 from a roll 30 of tab paper 32 on the web 12 in registration with the cut end 34 of the web 12. The cutting and tabbing assembly 26 includes a wheel 36 which rotates as described below. A knife 38 is mounted on the wheel 36. A tab bar 40 is mounted on the wheel 36 adjacent the knife 38 and has a mechanism which holds the tab paper 32. In one embodiment, this mechanism includes a source of vacuum 42 connected to the surface 44 of the tab bar 40 through a series of openings 46 on its surface 44. The roll of tab paper 30 is mounted on an unwinder 48 adjacent the wheel 36. The unwinder 48 includes the roll 30 of tab paper 32, a backup roller 50 located near the roll 30 of tab paper 32, and a tab paper guide 52 extending from the roll 30 of tab paper 32 to and around a portion of the backup roller 50. The unwinder 48 is translatable from a first position spaced from the knife 38 to a second position adjacent and contacting the knife 38. The unwinder 48 unwinds the proper amount of tab paper 32 for application on each log roll 54 during the winding of the web 12 on its core 14.

Figure 1B:
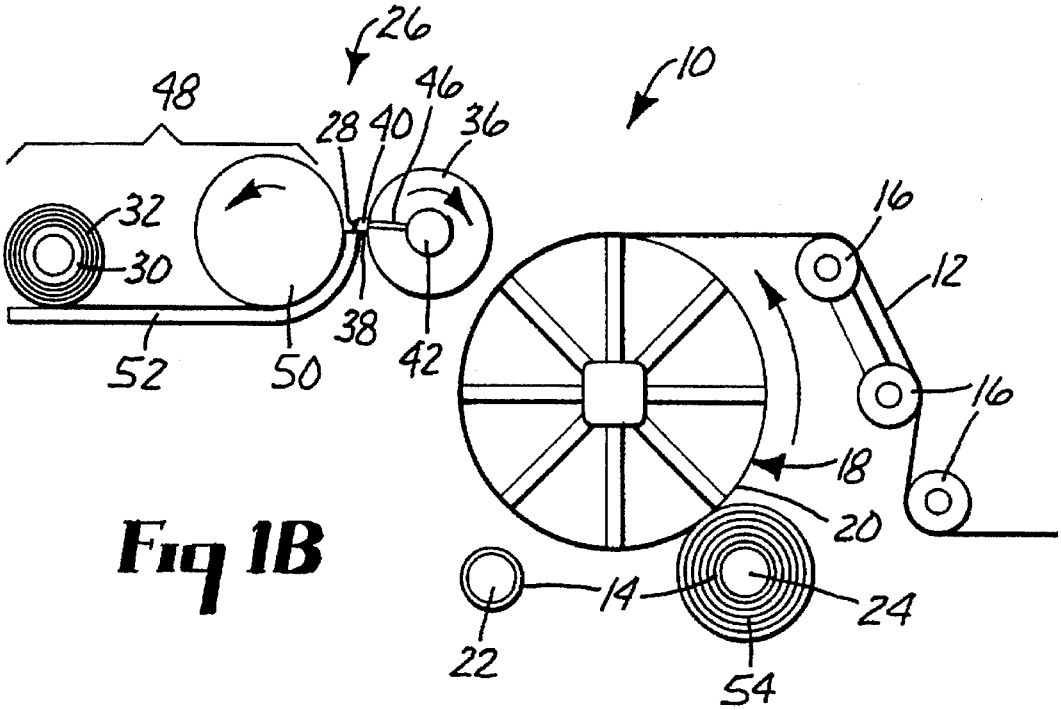
Figure 1C:
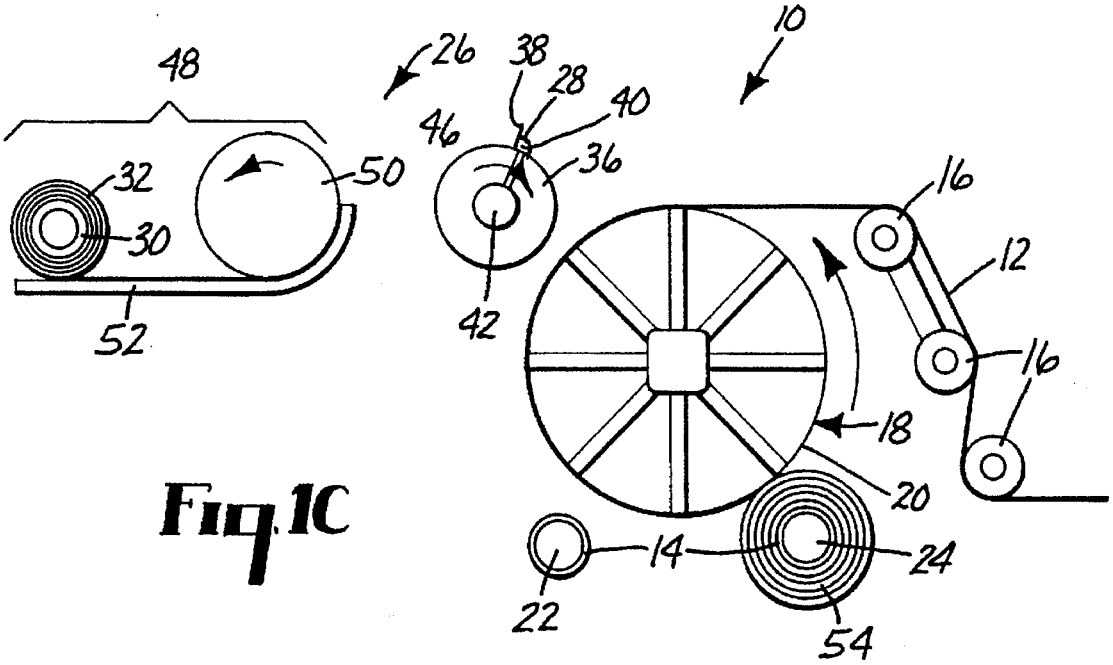
Figure 1D:
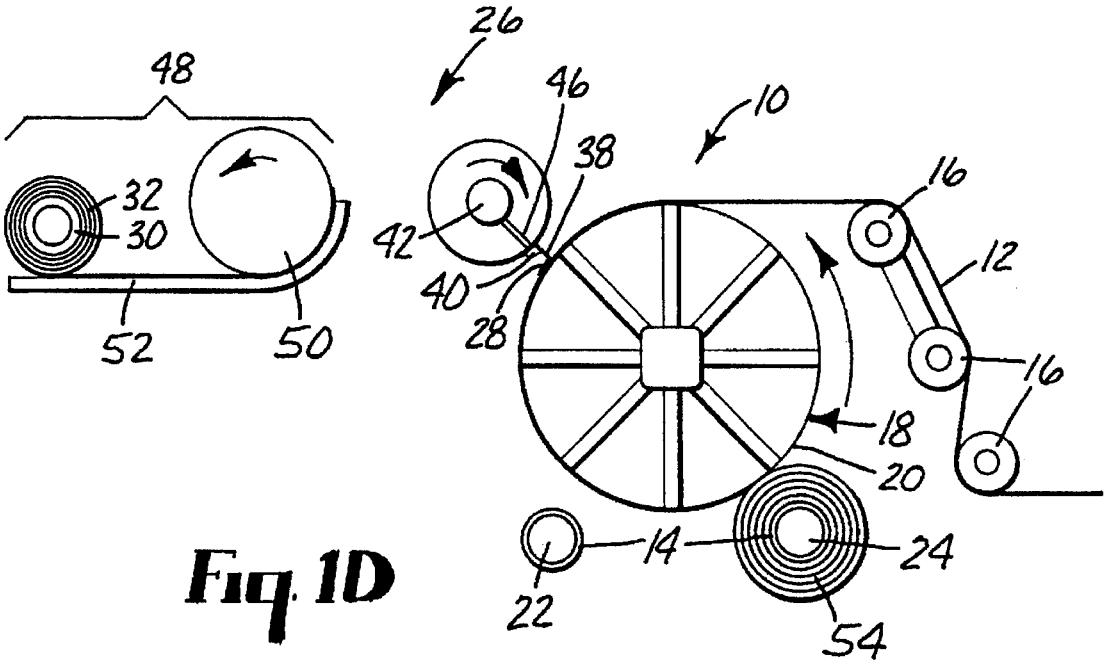
Figure 1E:
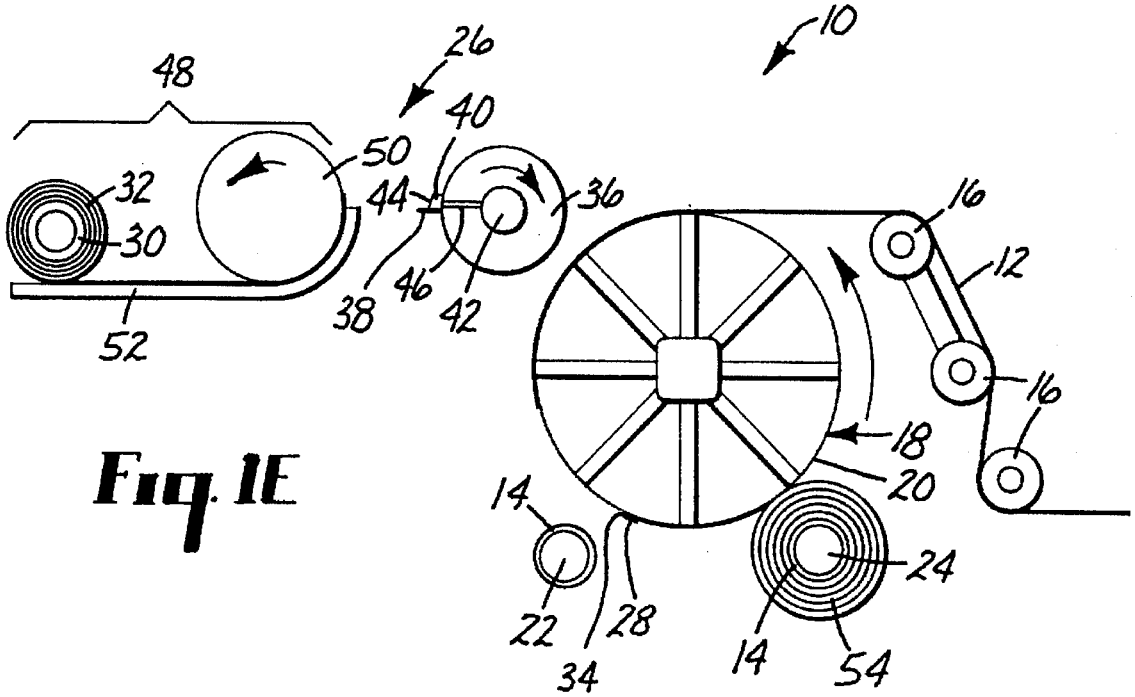

During the winding of the web 12 on its core 14, the wheel 36 is located in the tab-receiving position and the unwinder 48 is in its first position spaced from the wheel 36. After the unwinder 48 unwinds the proper amount of tab paper 32, the tab paper 32 is threaded between the knife 38 and the unwinder 48, as shown in FIG. 1A. The unwinder 48 is then moved to the second position in contact with the knife 38 and tab bar 40 while the knife 38 and tab bar 40 remain stationary, as shown in FIG. 1B. As the tab paper 32 contacts the knife 38, the knife 38 cuts a tab 28 from the tab paper 32 and the vacuum 42 on the tab bar 40 holds the tab 28. The unwinder 48 then returns to its first position. The tab 28 is held on the tab bar 40, and when the desired length of web 12 has been wound on its core 14, the wheel 36 rotates toward the web-cutting position in which the knife 38 can cut the web 12, as shown in FIG. 1C. As the wheel 36 rotates, the tab bar 40 transports the tab 28 to the web 12. As shown in FIG. 1D, as the wheel 36 reaches the web 12, the tab 28 is applied and the knife 38 contacts and cuts the web 12. The tab bar 40 accurately applies the tab 28 onto the web 12 in registration with the cut end 34 of the web 12. The adhesive on the web 12 enables the tab 28 to adhere to the web 12. The knife 38 and tab bar 40 continue to rotate until reaching the position shown in FIG. 1E, which is identical to that shown in FIG. 1A, and the sequence can begin again. As the drum 18 holds the cut ends 34 of the web 12 to prevent wrinkling, the cut and transfer can be performed on the fly without stopping the winding process such that the rolls 54 can be wound on line and at machine speeds on a continuous basis.

This tabbing system precisely cuts and applies tabs along the full width of the cut end of a log roll from a full width roll of tab paper using a simple configuration that is integrated with the web cutting assembly. This system has the following advantages over precut tabs. This tabbing system can be used with continuous on-line log roll winders as well as with more conventional noncontinuous log roll winders and rewind slitters. Excellent tab placement accuracy is provided as the same knife cuts both the tab and the web. Separate tab slitting steps are eliminated as the tabs are cut from a full width roll and individual strips of precut tabs need not be handled.

Figure 2A:
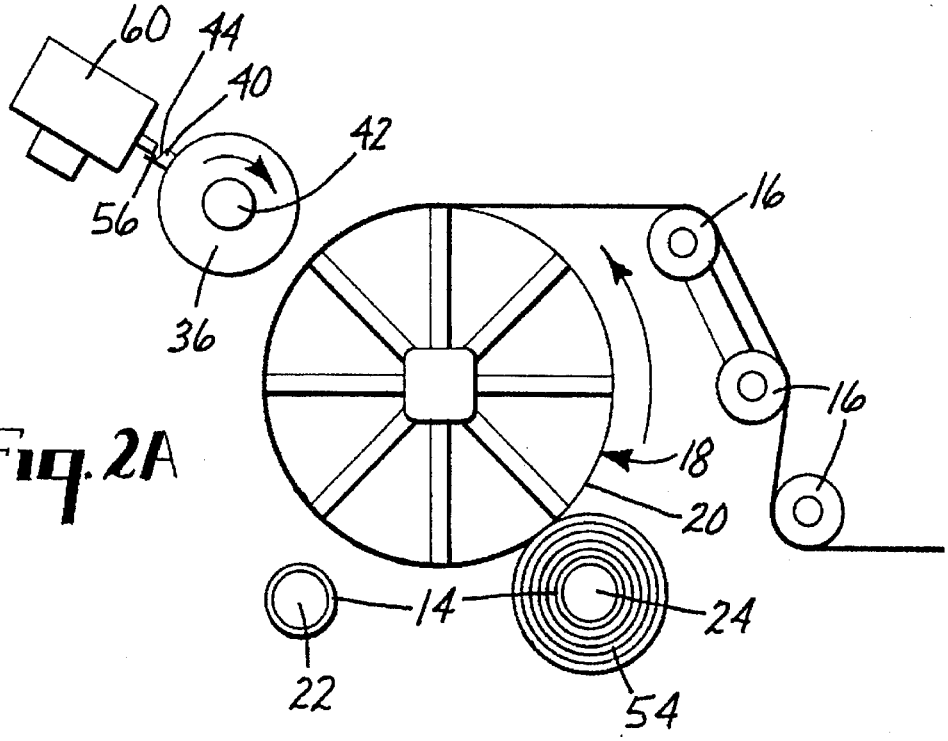
FIGS. 2A and 2B are schematic views of the tabbing system according to another embodiment of the present invention.
Figure 2B:
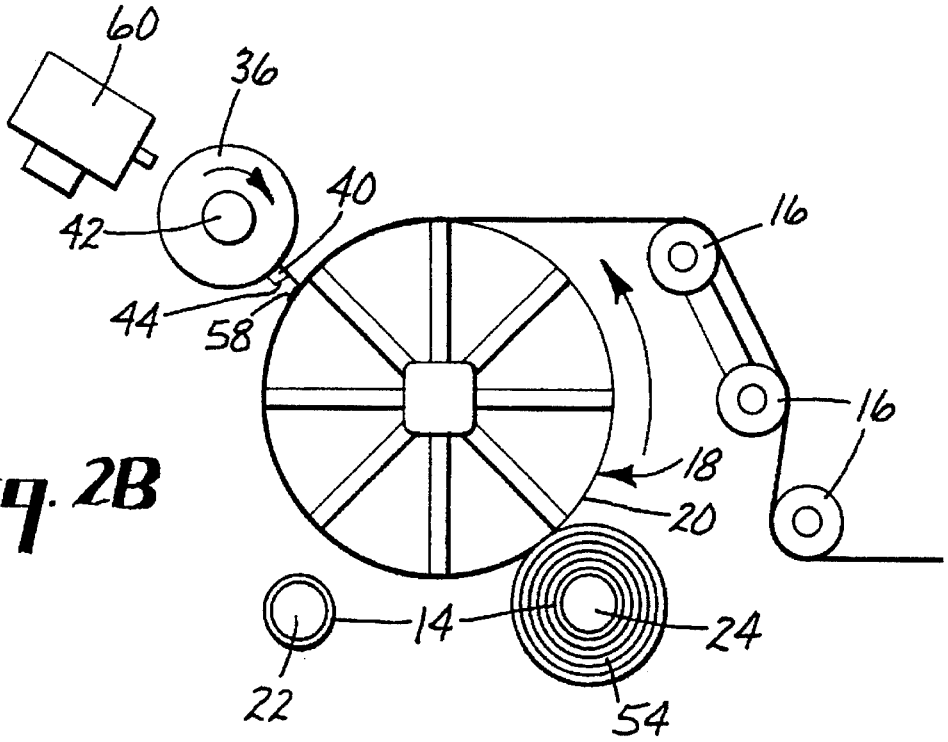

In an alternative embodiment of the cutting and tabbing assembly, shown in FIG. 2, rather than cut and fix a paper tab 28 on the cut end 34 of the web 12, a thermoplastic ink 56 can be applied to the web 12 to serve as the tab 58. In this embodiment, the tab bar 40 has a smooth surface 44. The sequence of operation for this embodiment is similar to that of the paper tab embodiment explained above with respect to FIG. 1. When the wheel 36 is in its tab-receiving position, as shown in FIG. 2A, an ink jet printer 60 applies the ink 56 to the tab bar 40 by traversing across the tab bar 40. As the wheel 36 rotates to its web-cutting position shown in FIG. 2B, the tab bar 40 applies the ink 56 to the web 12 during the cutting operation. Alternatively, the ink 56 can be applied directly to the web 12 from the printer 60 if the web is stopped. The ink 56 adheres to the adhesive on the web 12 forming a non-tacking surface 58 that acts as a tab on the end of the roll. The wheel 36 continues to its tab-receiving position to begin the cycle again. As the ink jet printer 60 can start and stop as it traverses across the web 12, printing the tab 58 can be adapted to the duplex cut and wind process in which the web 12 is preslit into predetermined widths and the ink tabs 58 are printed along the total width as the web 12 is cut. The starting and stopping of the printing can be aligned easily with each cut off knife and can be easily changed as the slit web width is changed by programming the printing head of the printer 60, which applies the ink onto the tab bar 40. The tab can be applied to alternate preslit strands while not being applied to the remaining strands.

Although adhesive is not required on the web to adhere the ink, adhesive is sometimes the reason for requiring the tab as the tab is used to assist in finding the end of the web and aid the start of unwinding. On nonadhesive webs, the tab ink or other material could be an adhesive to adhere the last wrap of the web to its roll. Also, by positioning the tab bar and tab on the other side of the knife, the adhesive tab is applied to the cut edge to be wound against the core and could adhere the first wrap of a nonadhesive web to the core. Additionally, instead of a thermoplastic ink, curable coatings can be used as the tab. The coatings could cure using light, chemical reactions, radiation, or heat. Detackifiers such as glass beads or talc also could be used.

Pressure sensitive adhesive (PSA) tape works well with these systems as do other adhesive-backed webs. The paper tab and the printed tab both serve to identify the end of a web roll and can be used to transmit advertising, identification, or other pertinent information about the web. In the printed tab, this information can be changed easily, on the fly, through the programmable electronics of the printer.

Numerous characteristics, advantages, and embodiments of the invention have been described in detail in the foregoing description with reference to the accompanying drawings. However, the disclosure is illustrative only and the invention is not intended to be limited to the precise embodiments illustrated. Various changes and modifications may be effected therein by one skilled in the art without departing from the scope or spirit of the invention.

We claim:

1. A cutting and tabbing assembly for use with a winding system for a web, comprising:

a) a wheel that rotates between a tab-receiving position and a web-cutting position;

b) a knife mounted on the wheel;

c) a tab bar mounted on the wheel adjacent the knife, wherein the tab bar comprises means for holding a tab;

d) a tab unwinder on which a supply of tab material is mounted, wherein the unwinder translates between a first position spaced from the wheel and a second position adjacent the wheel;

e) means for moving the unwinder from the first position to the second position to enable the knife to cut a tab from the tab material supply and the tab bar to receive the tab while the knife and tab bar are in the tab-receiving position; and f) means for rotating the knife and tab bar from the tab-receiving position to the web-cutting position to enable the knife to cut the web, and the tab bar to apply the tab onto the web in registration with a cut end of the web.

2. The cutting and tabbing assembly of claim 1 wherein the knife and tab bar combine to cut precisely and apply tabs along the full width of the cut end of the log roll.

3. The cutting and tabbing assembly of claim 1 wherein the holding means comprises a source of vacuum connected to the surface of the tab bar through a series of openings on its surface.

4. The cutting and tabbing assembly of claim 1 wherein the tab unwinder comprises:

a backup roller located near the roll of tab; and a tab paper guide extending from the roll of tab to and around a portion of the backup roller.

5. A cutting and tabbing assembly for use with a winding system for a web, the assembly comprising:

(a) means for cutting the web;

(b) a tab source;

(c) a tab bar mounted adjacent the cutting means for receiving a tab from the tab source;

(d) means for moving the tab source from a first position spaced from the cutting means and tab bar to a second position adjacent the cutting means and tab bar to enable the tab bar to receive a tab while the cutting means and tab bar are in a tab-receiving position; and (e) means for rotating the cutting means and tab bar from the tab-receiving position to a web-cutting position to enable the cutting means to cut the web, and the tab bar to apply the tab onto the web in registration with a cut end of the web.

6. The cutting and tabbing assembly of claim 5, wherein the cutting means comprises a knife.

7. The cutting and tabbing assembly of claim 5, wherein the tab source comprises an ink jet printer that applies ink to the tab bar.

8. The cutting and tabbing assembly of claim 5, wherein the ink is a thermoplastic ink.

9. The cutting and tabbing assembly of claim 6, wherein the tab source is a tab paper unwinder on which a roll of tab paper is mounted, the tab bar comprises means for holding the tab paper, and the means for moving the unwinder from a first position to a second position enables the knife to cut a tab from the tab paper roll.

10. The cutting and tabbing assembly of claim 5, wherein the web includes at least one major surface having a layer of pressure sensitive adhesive disposed thereon.

11. A cutting and tabbing assembly for use with a winding system for a web, the assembly comprising:

(a) means for cutting the web;

(b) a tab source;

(c) a tab bar mounted adjacent the cutting means for receiving a tab from the tab source;

(d) means for moving the tab source between a first position spaced from cutting means and tab bar and a second position adjacent the cutting means and tab bar to enable the tab bar to receive a tab; and (e) means for moving the cutting means and tab bar to a web-cutting position to enable the cutting means to cut the web, and the tab bar to apply the tab onto the web in registration with a cut end of the web.

12. The cutting and tabbing assembly of claim 11, wherein the cutting means comprises a knife.

13. The cutting and tabbing assembly of claim 11, wherein the tab source comprises an ink jet printer that applies ink to the tab bar.

14. The cutting and tabbing assembly of claim 13, wherein the ink is a thermoplastic ink.

15. The cutting and tabbing assembly of claim 12, wherein the tab source is a tab paper unwinder on which a roll of tab paper is mounted, the tab bar comprises means for holding the tab paper, and the means for moving the unwinder from a first position to a second position enables the knife to cut a tab from the tab paper roll.

16. The cutting and tabbing assembly of claim 11, wherein the web includes at least one major surface having a layer of pressure sensitive adhesive disposed thereon.

17. A cutting and tabbing assembly for use with a winding system for a web, the assembly comprising:

(a) means for cutting the web;

(b) a tab source;

(c) a tab bar mounted adjacent the cutting means for receiving a tab from the tab source;

(d) means for moving the cutting means and tab bar between a first position spaced from the tab source and a second position adjacent the tab source to enable the tab bar to receive a tab; and (e) means for moving the cutting means and tab bar to a web-cutting position to enable the cutting means to cut the web, and the tab bar to apply the tab onto the web in registration with a cut end of the web.

18. The cutting and tabbing assembly of claim 17, wherein the cutting means comprises a knife.

19. The cutting and tabbing assembly of claim 17, wherein the tab source comprises an ink jet printer that applies ink to the tab bar.

20. The cutting and tabbing assembly of claim 19, wherein the ink is a thermoplastic ink.

21. The cutting and tabbing assembly of claim 18, wherein the tab source is a tab paper unwinder on which a roll of tab paper is mounted, the tab bar comprises means for holding the tab paper, and the means for moving the unwinder from a first position to a second position enables the knife to cut a tab from the tab paper roll.

22. The cutting and tabbing assembly of claim 17, wherein the web includes at least one major surface having a layer of pressure sensitive adhesive disposed thereon.

23. A method of cutting a web that is moving in a direction and applying a tab on the web without stopping the movement of the web, comprising the steps of:

a) providing a tab material;

b) receiving a tab from the tab material;

c) transporting the tab to a location adjacent the web;

d) cutting the web against a cutting surface without stopping the movement of the web; and e) applying the tab to the web in registration with a cut end of the web.

24. The method of claim 23, wherein the tab material is ink.

25. The method of claim 23, wherein the tab material is paper.

26. The method of claim 23, wherein the web cutting and tab applying steps occur simultaneously.

27. The method of claim 23, wherein step b) comprises cutting a tab from the supply of tab material with a knife by moving the tab material toward the knife; step c) comprises transporting the tab with a tab bar by rotating the tab bar from the supply of tab material toward the cutting surface.

28. The method of claim 23, wherein step d) includes the step of heating the knife prior to cutting the web.

29. The method of claim 23, wherein step b) includes the steps of providing a tab bar, and of applying a vacuum force through a plurality of holes in a surface of the tab bar to enable a tab to be received on the surface of the tab bar.

* * * * *